US011572760B2

(12) United States Patent
Brown et al.

(10) Patent No.: US 11,572,760 B2
(45) Date of Patent: Feb. 7, 2023

(54) MODIFIED SAND FALLBACK PREVENTION TOOL

(71) Applicant: Halliburton Energy Services, Inc., Houston, TX (US)

(72) Inventors: Donn J. Brown, Broken Arrow, OK (US); David Christopher Beck, Broken Arrow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/074,378

(22) Filed: Oct. 19, 2020

(65) Prior Publication Data

US 2021/0180429 A1 Jun. 17, 2021

Related U.S. Application Data

(60) Provisional application No. 62/949,444, filed on Dec. 17, 2019.

(51) Int. Cl.

| | |
|---|---|
| ***E21B 34/08*** | (2006.01) |
| ***E21B 33/12*** | (2006.01) |
| ***E21B 43/38*** | (2006.01) |
| ***E21B 27/00*** | (2006.01) |
| ***E21B 43/12*** | (2006.01) |

(52) U.S. Cl.

CPC ..... *E21B 34/08* (2013.01); *E21B 27/00* (2013.01); *E21B 33/1208* (2013.01); *E21B 43/128* (2013.01); *E21B 43/38* (2013.01)

(58) Field of Classification Search

CPC ..... E21B 34/08; E21B 33/1208; E21B 27/00; E21B 11/04; E21B 31/08; E21B 43/38; E21B 43/128; E21B 43/13; E21B 43/35

See application file for complete search history.

(56) References Cited

U.S. PATENT DOCUMENTS

| | | | | |
|---|---|---|---|---|
| 6,289,990 | B1 | 9/2001 | Dillon et al. | |
| 2007/0095545 | A1* | 5/2007 | Lembcke | E21B 34/08 166/332.8 |
| 2014/0014358 | A1 | 1/2014 | Leitch | |
| 2017/0328190 | A1* | 11/2017 | Fielder, III | E21B 27/00 |
| 2018/0266210 | A1* | 9/2018 | Melenyzer | E21B 43/128 |
| 2019/0003296 | A1 | 1/2019 | Fielder, III et al. | |
| 2019/0360302 | A1* | 11/2019 | Nowitzki | E21B 34/08 |

FOREIGN PATENT DOCUMENTS

| | | | | |
|---|---|---|---|---|
| WO | WO-2018052857 | A1 * | 3/2018 | E21B 43/128 |
| WO | 2018052470 | A1 | 1/2019 | |

OTHER PUBLICATIONS

International Search Report and Written Opinion for PCT application No. PCT/US2020/056373 dated Feb. 3, 2021, 9 pages.

* cited by examiner

*Primary Examiner* — George S Gray
(74) *Attorney, Agent, or Firm* — Conley Rose, P.C.; Rodney B. Carroll

(57) ABSTRACT

A downhole tool and method therefor use a deviated flow path to prevent/mitigate fallback of solids during shutdown of an ESP. The deviated flow path leverages the direction of fallback downhole and the relative inertias of the solid particulates and the fluid to minimize fallback into the ESP. The particulates change flow direction more slowly than fluid, and thus largely avoid the deviated flow path to instead fall through a bypass path during fallback. This obviates the need for mechanical valves that may be subject to excessive mechanical wear or other issues associated with solid particulates.

20 Claims, 9 Drawing Sheets

MODIFIED SAND FALLBACK PREVENTION TOOL

CROSS-REFERENCE TO RELATED APPLICATIONS

This application claims the benefit of and priority to U.S. Provisional Application No. 62/949,444, entitled "Modified Sand Fallback Prevention Tool," filed on Dec. 17, 2019, which is incorporated by reference herein in its entirety. This application is also related in subject matter to International Application No. PCT/US2016/051461, entitled "Modified Sand Fallback Prevention Tool," filed on Sep. 13, 2016.

BACKGROUND OF THE INVENTION

1. Field of the Invention

The present disclosure relates to downhole tools, such as those used in oil and gas wells, and more particularly to tools for reduction of inoperability and/or damage to electrical submersible pumps due to solid particles (e.g., formation sand, proppant, and the like) fallback.

2. Description of Related Art

Natural formation sands and/or hydraulic fracturing proppant (referred to herein as sand) in subterranean oil and gas wells can cause significant problems for electrical submersible pumps (ESP). Once sand is produced through the ESP it must pass through the tubing string prior to reaching the surface. Sand particles often hover or resist further movement in the fluid stream above the ESP or move at a much slower velocity than the well fluid due to physical and hydrodynamic effects. When the ESP is unpowered, fluid and anything else in the tubing string above the pump begins to flow back through the pump. Check valves are often used to prevent flow back while also maintaining a static fluid column in the production tubing. However, check valves are subject to failures caused by solids, including sand.

Thus, while conventional methods and systems have generally been considered satisfactory for their intended purpose, there is still a need in the art for improved sand fallback prevention/mitigation tools that protect the operability and reliability of ESPs. The present disclosure provides a solution for this need.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
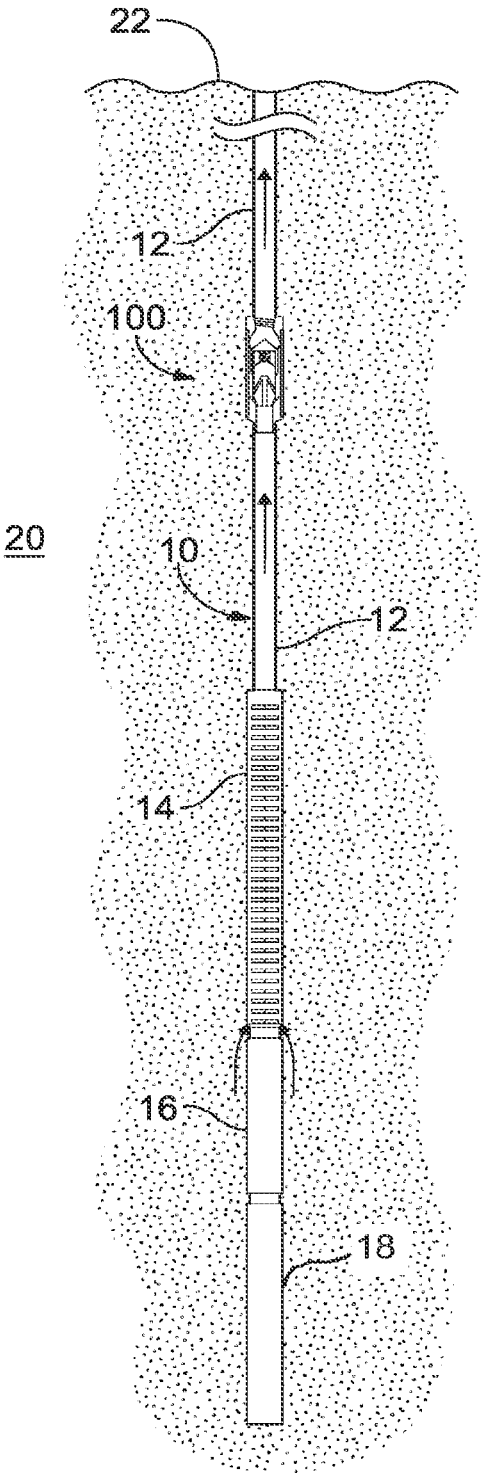
FIG. 1 (Prior Art)
FIG. 1 is a schematic side elevation view of an exemplary embodiment of a downhole tool constructed in accordance with the present disclosure, showing the downhole tool in a string that includes a motor and electrical submersible pump (ESP), wherein the string is in a formation for production of well fluids that may contain any combination of water, hydrocarbons, and minerals that naturally occur in oil and gas producing wells.

Reference will now be made to the drawings wherein like reference numerals identify similar structural features or aspects of the subject disclosure. For purposes of explanation and illustration, and not limitation, a partial view of an exemplary embodiment of a downhole tool in accordance with the disclosure is shown in FIG. 1 and is designated generally by reference character 100. Other embodiments of downhole tools in accordance with the disclosure, or aspects thereof, are provided in FIGS. 2-8, as will be described. The systems and methods described herein can be used to mitigate, reduce or prevent fallback sand reaching an electrical submersible pumps (ESP) in downhole operations such as in oil, gas, and/or water producing wells.

Figure 2:
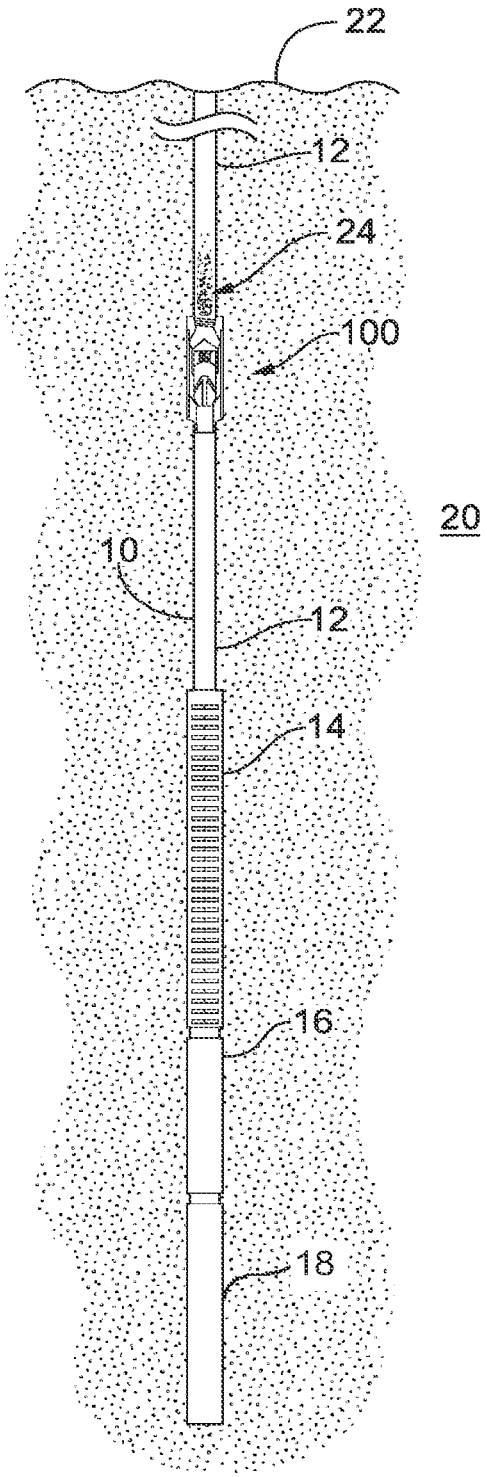
FIG. 2 (Prior Art)
FIG. 2 is a schematic side elevation view of the downhole tool of FIG. 1, showing the tool preventing/mitigating fallback sand from reaching the ESP during shutdown of the ESP.

Referring to FIG. 1, a string 10 includes production tubing 12, downhole tool 100, ESP 14, protector 16, and motor 18 for driving ESP 14. These components are strung together in a formation for production, e.g., of oil, gas and/or water, from within formation 20. In FIG. 1, the flow arrows indicate operation of ESP 14 to receive fluids in from formation 20 then drive through production tubing 12 and downhole tool 100 to the surface 22. As shown in FIG. 2, when ESP 14 stops pumping, fallback sand 24 in the production tubing 12 above downhole tool 100 recedes toward the ESP 14, but is mitigated or prevented from reaching ESP 14 by downhole tool 100.

Figure 3:
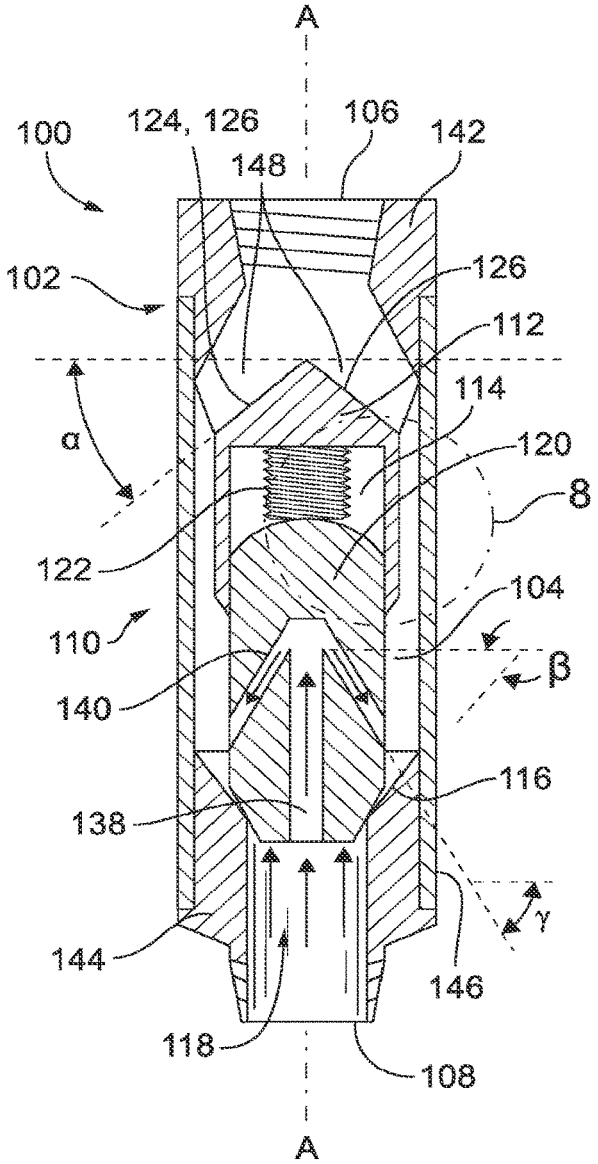
FIG. 3 (Prior Art)
FIG. 3 is a schematic cross-sectional elevation view of the downhole tool of FIG. 1, showing the valve poppet in the closed position with flow arrows indicating the flow during opening of the poppet valve and just prior to establishment of a full flow condition.

With reference now to FIG. 3, downhole tool 100 is configured for sand fallback prevention/mitigation as described above. Downhole tool 100 includes a housing 102 defining a flow path 104 therethrough in an axial direction, e.g. generally along axis A, from an upper opening 106 to a lower opening 108. Depending on the direction of flow, upper opening 106 may be an inlet or an outlet, and the same can be said for lower opening 108. Those skilled in the art will readily appreciate that while axis A is oriented vertically, and while upper and lower openings 106 and 108 are designated as upper and lower as oriented in FIGS. 3-7, other orientations are possible including horizontal or oblique angles for axis A, and that the upper opening 106 need not necessarily be above lower opening 108 with respect to the direction of gravity. Upper opening 106 is closer than lower opening 108 in terms of flow reaching surface 22, shown in FIG. 1, regardless of the orientation of downhole tool 100.

A poppet valve 110 is mounted within the housing. The poppet valve 110 includes an upper member 112 defining an upper chamber 114 mounted in the flow path 104 so that flow through the flow path 104 flows around the upper member 112. A valve seat 116 is mounted in the flow path 104 with an opening 118 therethrough. A valve poppet 120 is mounted for longitudinal movement, e.g., in the direction of axis A, within the flow path 104 between a closed position, shown in FIG. 3, in which the valve poppet 120 seats against the valve seat 116 to block flow through the flow path 104, and an open position, shown in FIG. 4, in which the valve poppet 120 is spaced apart from the valve seat 116 to permit flow through the flow path 104.

Figure 4:
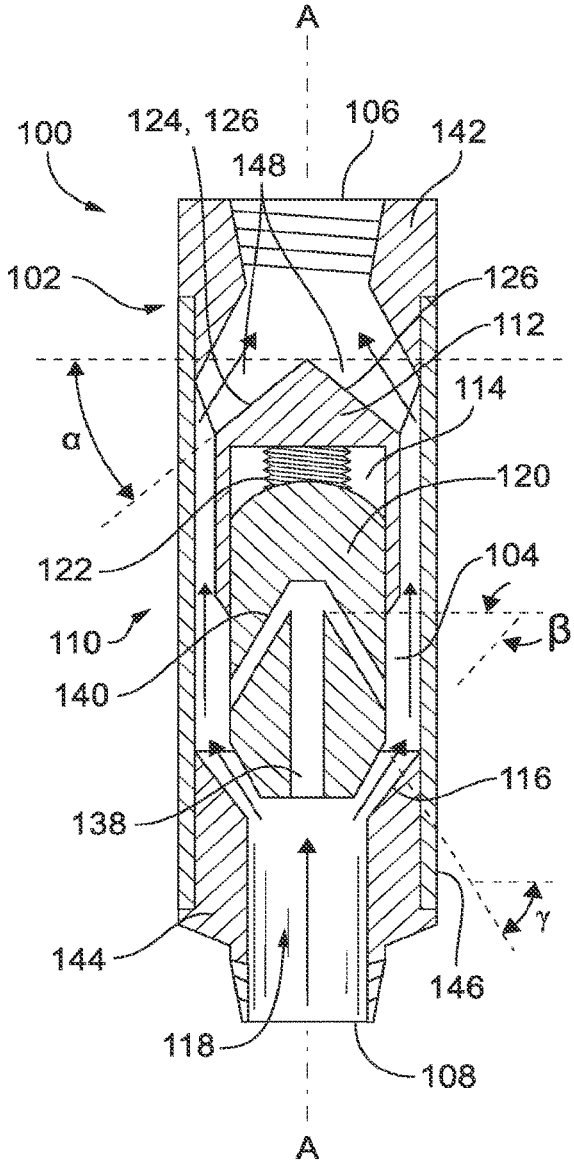
FIG. 4 (Prior Art)
FIG. 4 is a schematic cross-sectional elevation view of the downhole tool of FIG. 1, showing the valve poppet in the open position, flowing as during production with a full flow condition.

In both the open and closed positions, as shown in FIGS. 4 and 3, respectively, the valve poppet 120 remains at least partially within the upper chamber 114 so that the upper chamber 114 is always enclosed to prevent/mitigate accumulation of fallback sand above the valve poppet 120. A biasing member 122 is seated in the upper chamber 114 biasing the valve poppet 120 toward the valve seat 116. The biasing member can be configured to provide either an opening or closing force sized/calibrated with respect to fluid properties, slurry characteristics and flow conditions for moving the valve poppet 120 from the open/closed position to the closed/opened position. Biasing member 122 may be used to eliminate the need for gravitational forces assisting valve closure, e.g., in horizontal or deviated wells.

The upper member 112 includes an upper surface 124 with at least one angled portion 126 that is angled, e.g., at angle $\alpha$ below the level dashed line in FIG. 3, to resist accumulation of sand on the upper surface. For example angle $\alpha$ can be greater than the angle of repose, e.g. 45° of the fallback sand and/or debris expected to be present in downhole tool 100.

Figure 8:
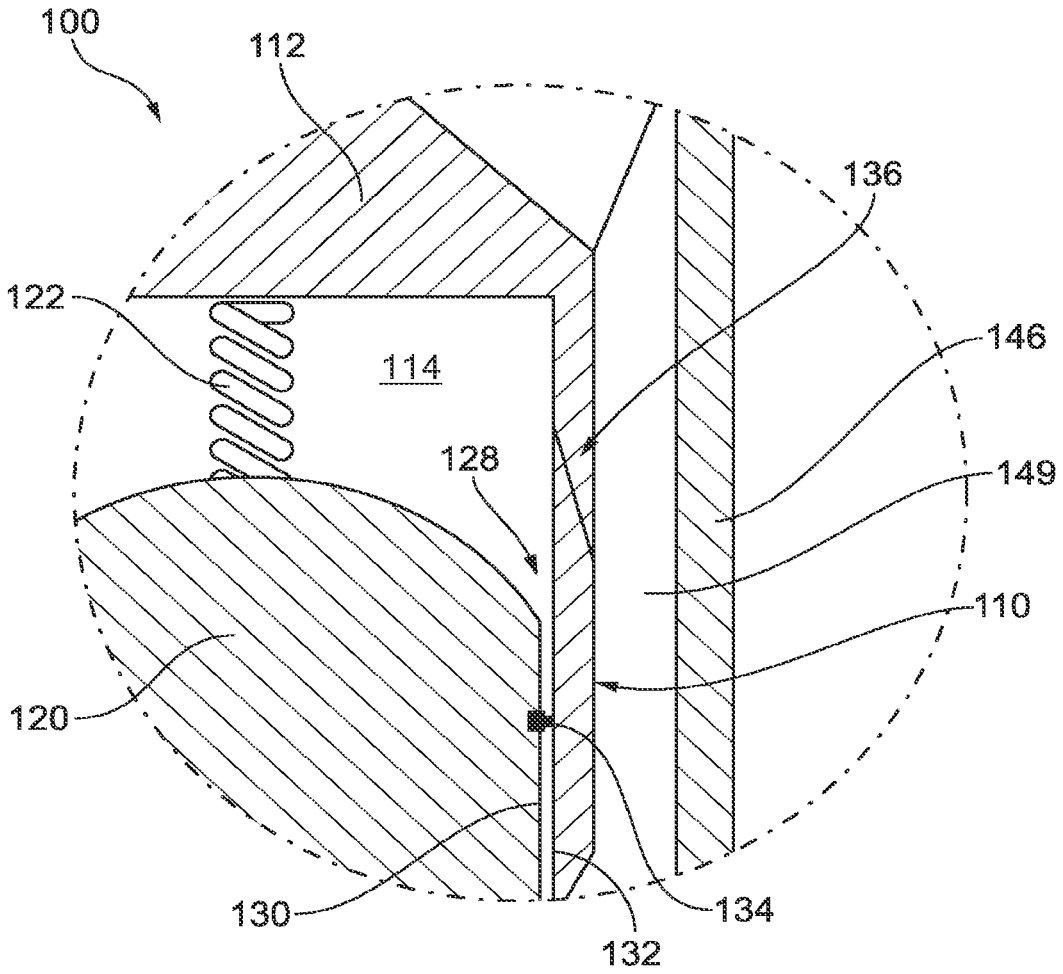
FIG. 8 (Prior Art)
FIG. 8 is a schematic cross-sectional elevation view of a portion of the downhole tool of FIG. 1, showing the weep hole and wiper seal features of the valve that assist in enabling and protecting the upper movement of the valve's poppet.

As shown in FIG. 8, the valve poppet 120 is narrower than the upper chamber 114, and there is therefore a gap 128 to allow movement of the valve poppet 120 without resistance from fallback sand or debris. Valve poppet 120 includes an axially oriented perimeter surface 130 matched in shape, e.g., cylindrical, with an axially oriented interior surface 132 of the upper chamber 114. A wiper seal 134 engages between the valve poppet 120 and the upper member. The wiper seal 134 may be configured to allow passage of fluid while inhibiting passage of sand or debris, to keep upper chamber 114 and gap 128 clear of sand or debris. While only one wiper seal 134 is shown, those skilled in the art will readily appreciate that any suitable number of wiper seals can be used, or other sealing mechanisms may be employed to achieve the same result of restricting debris passage while allowing liquid to seep across the sealing interface. A weep hole 136 can be defined through the upper member 112 from a space outside the upper chamber 114 to a space inside the upper chamber 114. The weep hole 136 is configured to equalize pressure between the flow space outside the upper chamber 114 with the cavity inside the upper chamber 114. A filter material can be included within the weep hole 136 to assist with preventing sand/debris from entering the upper chamber 114. Upper chamber 114 can be lengthened to any suitable length along valve poppet 120 for a given application, as the length helps prevent debris migration into upper chamber 114.

With reference again to FIG. 4, the valve seat 116 is defined by an angular surface, angled at angle $\beta$ below horizontal as oriented in FIG. 4. This encourages wedging of sand during closing of the valve poppet 120 against the valve seat 116. The angle $\beta$ also serves to limit restrictive forces while opening the poppet valve 110. A poppet channel 138 is defined through the valve poppet 120 for limited fluid communication through the flow path 104 with the valve poppet 120 in the closed position. The poppet channel 138 can have a flow area equal to one-half of that through the flow path 104 with poppet valve 120 in the open position, or greater. The poppet channel 138 can include one or more tributaries 140, each with an opening on the peripheral surface 130 of the poppet valve 120. Each of the tributaries 140 of the poppet channel 138 is directed downward toward the valve seat 116 for initiating a buoyancy change in sand seated between the valve seat 116 and the valve poppet 120 prior to the valve poppet 120 moving from the closed position to the open position. This type of flow is indicated in FIG. 3 with flow arrows. Each tributary 140 of the poppet channel can be defined along a tributary axis angled downward equal to an angle $\gamma$, e.g., or more than 45° from level. This angle $\gamma$ mitigates sand migrating upward through the channel tributary 140. Housing 102 includes a head 142 including the upper member 112 and upper opening 106. When excessive sand is present, the angle $\gamma$ and small channel diameter can prevent a constant flow of sand slurry in the reverse direction thereby creating a plug effect.

Housing 102 also includes a base 144 including the lower opening 108 and the valve seat 116. Hosing 102 further includes a housing body 146 mounted to the head 142 and base 144, spacing the head 142 and base 144 apart axially. Flow path 104 includes upper opening 106, passages 148 through head 142, the space 149 between housing body 146 and poppet valve 110 (as shown in FIG. 8), the space between valve poppet 120 and valve seat 106, opening 118 through valve seat 116, and lower opening 108. Head 142 and base 144 can include standard external upset end (EUE) connections for ease of installation of downhole tool 100 in a production tubing string above an ESP. Multiple downhole tools 100 an be strung together for cumulative effect and redundancy. Surfaces of head 142 may be coated or hardened to help mitigate erosion. The flow area can be slightly larger than the passageway of an ESP pump head with shaft coupling installed. Tool 100 may have multiple sizes to reflect a like ESP pump head passage way with shaft coupling installed.

Figure 5:
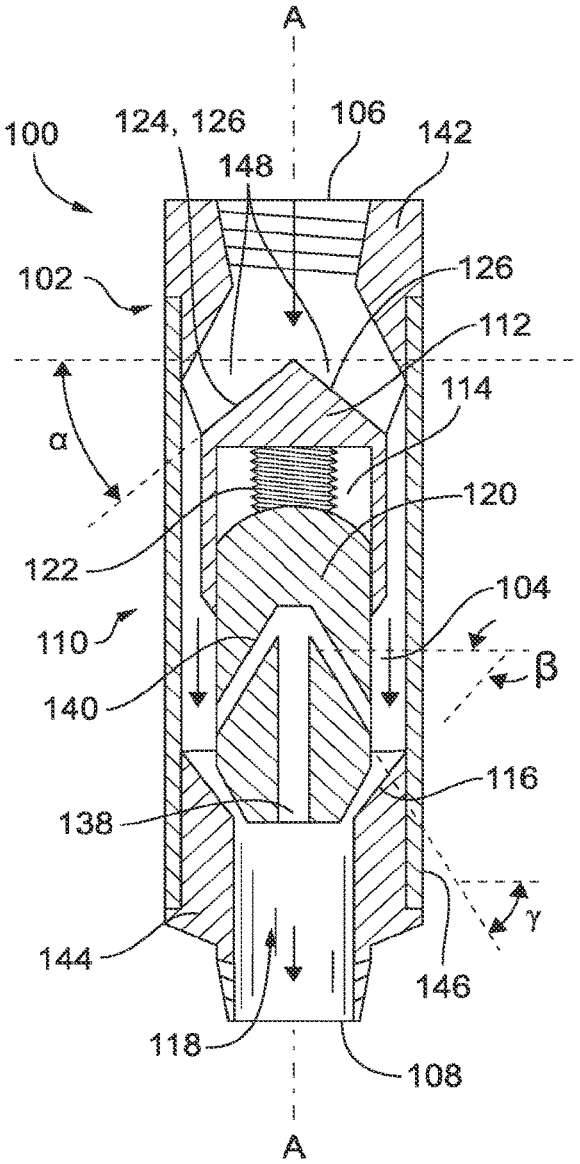
FIG. 5 (Prior Art)
FIG. 5 is a schematic cross-sectional elevation view of the downhole tool of FIG. 1, showing the valve poppet closing immediately after powering down the ESP thereby inducing a reverse flow condition in the production tubing and valve.
Figure 6:
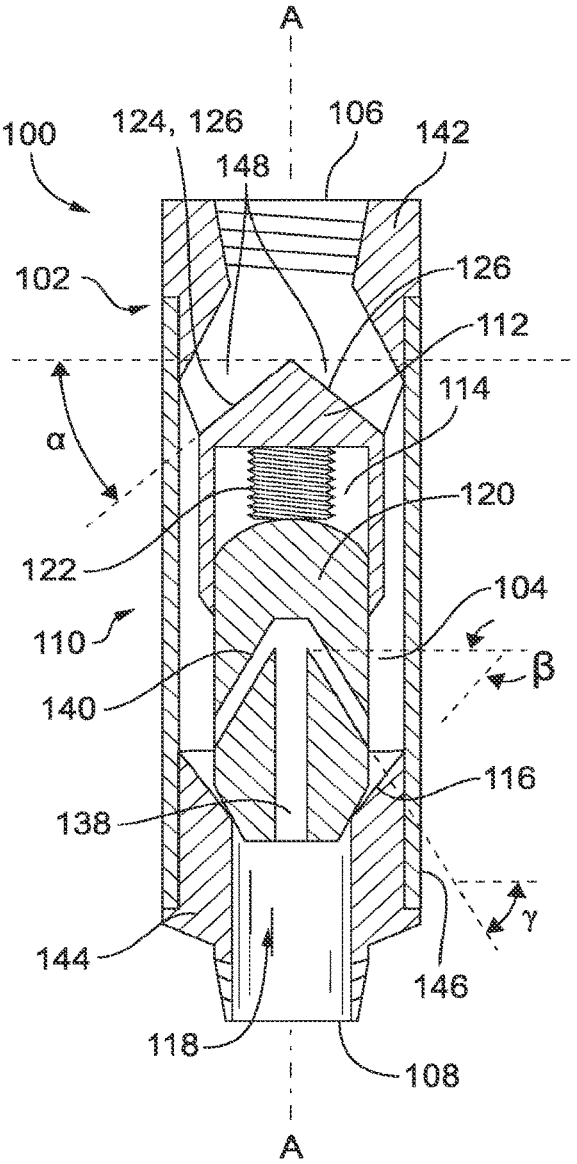
FIG. 6 (Prior Art)
FIG. 6 is a schematic cross-sectional elevation view of the downhole tool of FIG. 1, showing the valve poppet in the closed position restricting/mitigating sand fallback toward the ESP.

A method of reducing fallback sand reaching an electrical submersible pump (ESP) includes holding a valve poppet, e.g., valve poppet 120, in an open position by operating an ESP, e.g., ESP 14, to drive flow through a flow path, e.g., flow path 114, past the valve poppet, as shown in FIG. 4, where the flow arrows indicate flow with the valve poppet in an open and flowing position. The method also includes moving the valve poppet into a closed position blocking the flow path by reducing flow from the ESP. FIG. 5 shows the valve poppet 120 moving to the closed position, wherein the flow arrows indicate back flow during shut down of ESP 14. In the closed position of poppet valve 120, shown in FIG. 6, valve poppet 120 restricts sand at the valve seat interface, thereby causing sand accumulation alongside the valve poppet 120, within the tributaries 140 and throughout the normal downstream flow path(s) of flow path 104, passages 148, and upper opening 106 while the valve poppet is in the closed position. In the closed position, back flow can be allowed thorough a poppet channel, e.g., poppet channel 138, defined through the valve poppet. This can allow for flow of chemical treatments for ESP from the surface during shutdown, for example.

Figure 7:
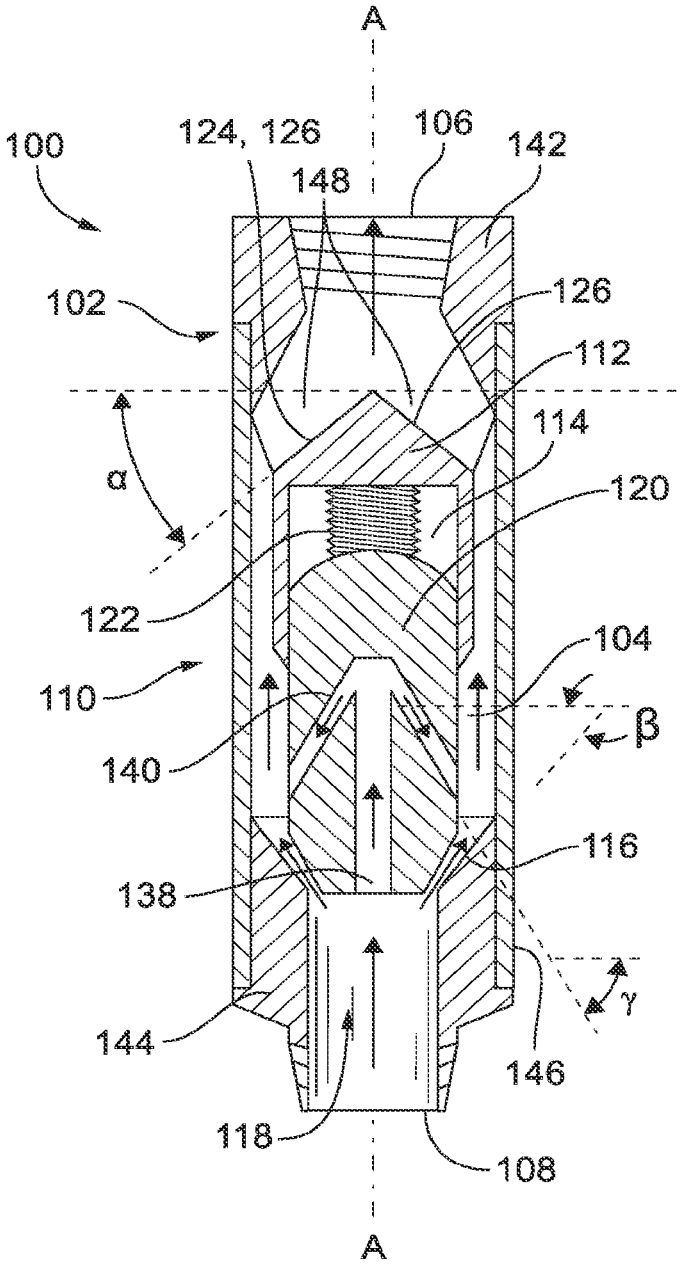
FIG. 7 (Prior Art)
FIG. 7 is a schematic cross-sectional elevation view of the downhole tool of FIG. 1, showing the valve poppet re-opening while sand is restrained above the lower opening of the downhole tool.

Referring now to FIG. 3, initiating movement of the valve poppet from the closed position to an open position can be done by directing flow through a tributary, e.g. tributary 140, of the poppet channel defined through the valve poppet. This flow through the tributary is directed at sand accumulated between the valve poppet and an adjacent valve seat, e.g. valve seat 116. Thereafter, as ESP increases the flow pressure, the valve poppet overcomes the biasing member, e.g., biasing member 122, to move to the open position as shown in FIG. 7. This discharges accumulated fallback sand from a tool, e.g., downhole tool 100, in an upward direction toward the surface 22 as indicated by the flow arrows in FIG. 7.

In some embodiments, instead of using a poppet, check, diverter or some other valve to prevent/mitigate fallback of solids into the ESP, no valve is incorporated into the downhole tool. Rather, the downhole tool employs a deviated flow path to prevent/mitigate fallback of solids during shutdown of the ESP. The deviated flow path leverages the direction of fallback downhole and the relative inertias of the solid particulates and the fluid to minimize fallback into the ESP. In particular, particulates tend to change flow direction more slowly than fluid, and can thus largely avoid the deviated flow path to instead fall through a bypass path during fallback. This obviates the need for mechanical valves that may be subject to excessive mechanical wear or other issues associated with solid particulates.

Figure 9:
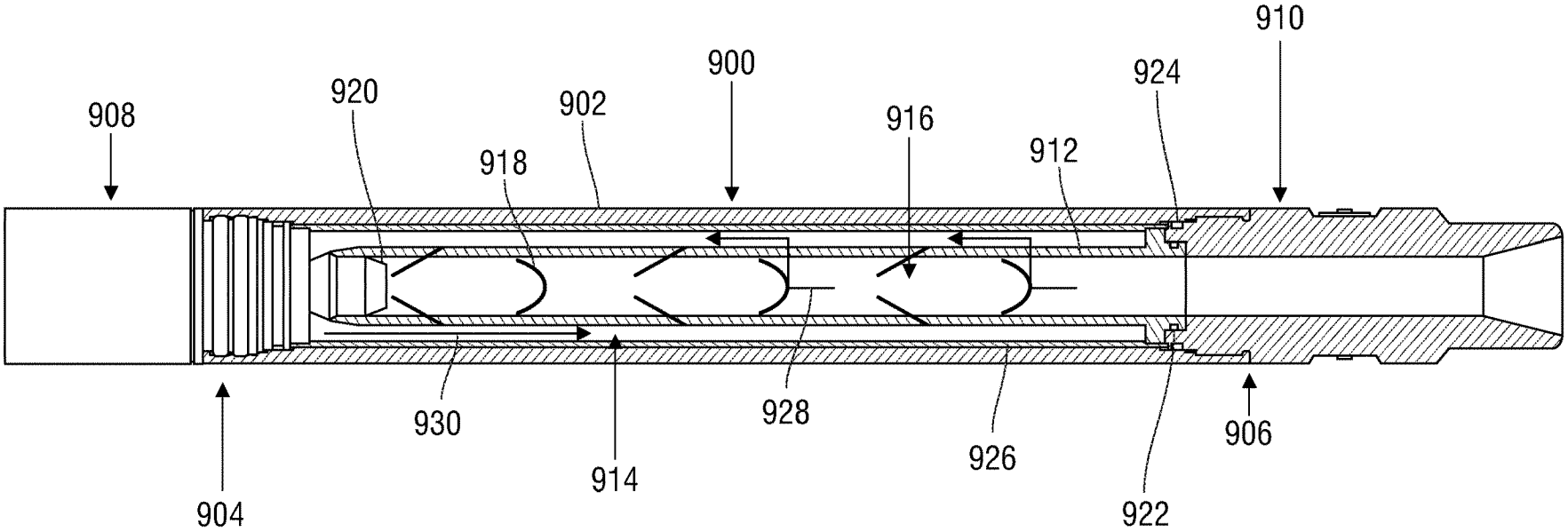
FIG. 9 is a schematic cross-sectional side view of an embodiment of the downhole tool that use a deviated flow path instead of a poppet, check, diverter or other valve.

Referring now to FIG. 9, a schematic cross-sectional side view of a downhole tool 900 is shown that uses a deviated flow path instead of a poppet, check, diverter or other valve in some embodiments. This downhole tool 900 may be installed in place of the downhole tool 100 in the string 10 of FIG. 1. As can be seen, the downhole tool 900 includes a tool housing 902 having openings at an upper end 904 and a lower end 906 of the tool. The upper end 904 of the downhole tool 900 is coupled to a tool coupling 908 that connects the tool 900 to tubing or additional tools or equipment (not expressly shown) further uphole. The lower end 906 of the downhole tool 900 is coupled to an ESP coupling 910 that connects the tool 900 to an ESP or similar pump (not expressly shown) further downhole. The downhole tool 900, the tool coupling 908, and the ESP coupling 910 together form a downhole assembly that can prevent/mitigate fallback of solids during shutdown of the ESP.

In accordance with the disclosed embodiments, an inner conduit 912 is positioned within the tool housing 902 such that an annulus 914 is formed between the inner conduit 912 and the tool housing 902. In the embodiment shown, the inner conduit 912, like the tool housing 902, has openings adjacent the upper and lower ends 904, 906 of the downhole tool 900 that define an inner flow path 916 extending from the ESP coupling 910 toward the tool coupling 908. A plurality of slots 918 are formed or otherwise created in the inner conduit 912. The slots 918 allow fluid (e.g., from the ESP) to flow from the inner flow path 916 of the inner conduit 912 into the annulus 914 and subsequently to the tool coupling 908.

A flow plug 920 is positioned adjacent the upper end 904 of the downhole tool 900. The flow plug 920 is coupled or otherwise attached to the inner conduit 912 such that the opening in the inner conduit 912 at that end of the tool 900 is plugged. In the embodiment shown, the flow plug 920 is positioned within the inner conduit 912, but a cap or cover type flow plug may also be used in some embodiments, so long as the flow plug 920 stops fluid from flowing through the inner conduit 912. Any suitable coupling means (e.g., pressed-fit, threads, etc.) may be used to couple the flow plug 920 to the inner conduit 912.

In some embodiments, the flow plug 920 forms part of the tool coupling 908 such that it protrudes from the tool coupling 908. For example, the flow plug 920 may be attached to or mounted on two or more support structures 921 (shown in FIG. 10) that extend radially from the interior wall of the tool coupling 908. The support structures 921 may resemble flat, blade-like structures to avoid impeding the flow of fluid through the tool coupling 908. It is also possible to provide the flow plug 920 as an attachment that is separately attached (e.g., screwed) to the tool coupling 908 in some embodiments. Alternatively, the flow plug 920 may be replaced with an endcap or lid on the upper end of the inner conduit 912 in some embodiments. In any case, such a flow plug 920 forces fluid (e.g., from the ESP) flowing through the inner flow path 916 of the inner conduit 912 to deviate through the slots 918 into the annulus 914.

In some embodiments, inner and outer seals 922 and 924, which may be O-rings in some implementations, provide a fluid tight seal between the ESP coupling 910 and the tool housing 902 and inner conduit 912. In some embodiments, an outer conduit 926 may be positioned within the tool housing 902 such that the annulus 914 is formed between the inner conduit 912 and the outer conduit 926 instead of the tool housing 902.

In general operation, when the ESP is pumping, fluid flows through the ESP coupling 910 along the inner flow path 916 until the fluid encounters the flow plug 920. The flow plug 920 forces the fluid to follow a deviated flow path 928 that runs through the slots 918 into the annulus 914 where the fluid continues through to the tool coupling 908. When the ESP shuts down, gravity causes the fluid in the annulus 914 to fall towards the ESP coupling 910, reversing through the deviated flow path 928 back to the ESP coupling 910. Solid particulates in the fluid, however, will resist a change in direction more than the fluid, and thus will largely avoid reversing through the deviated flow path 928. The solid particulates will instead continue along a bypass fallback path 930 and accumulate in the annulus 914.

Figure 10:
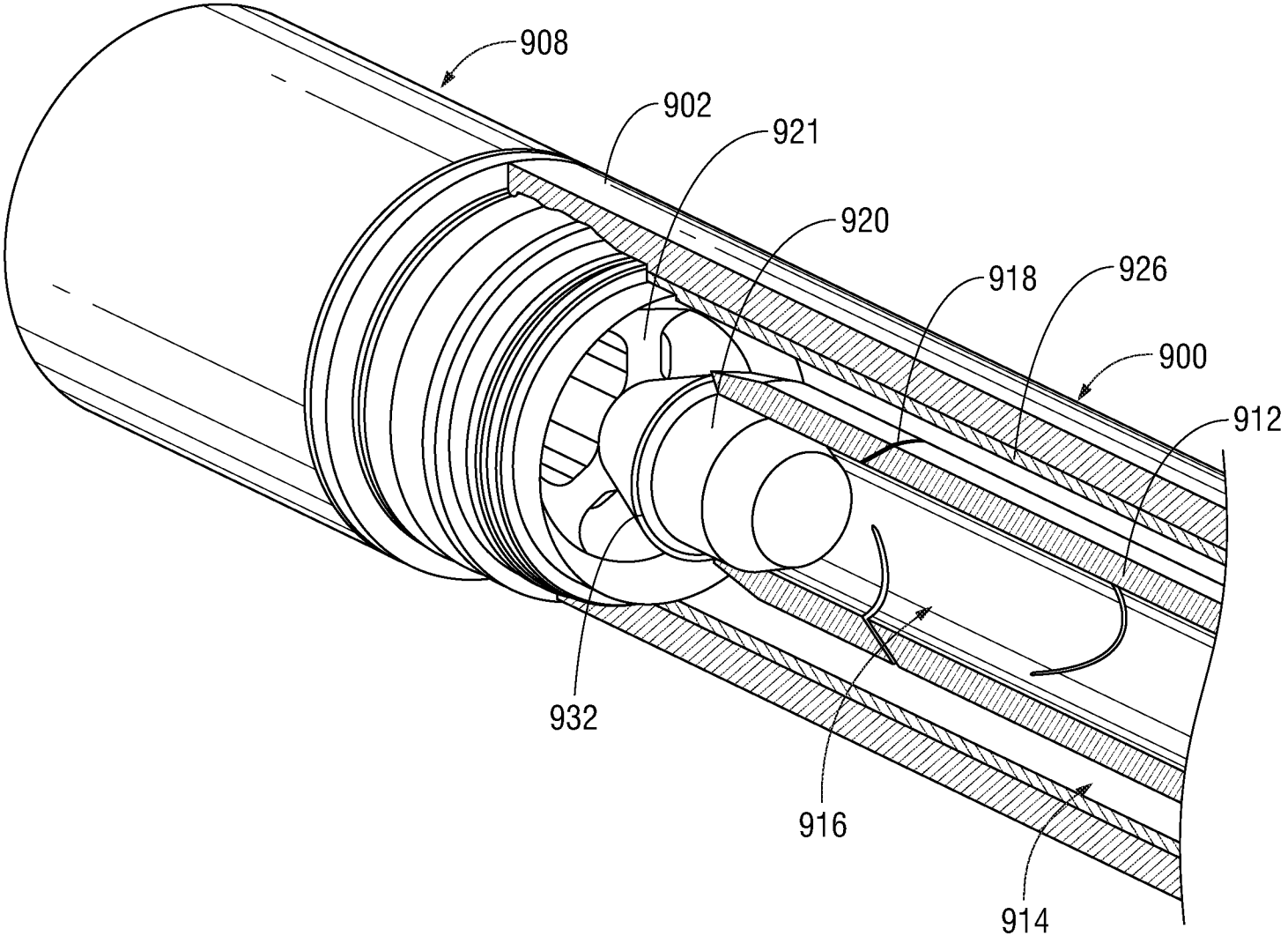
FIG. 10 is a schematic cross-sectional elevation view of the embodiment of the downhole tool having a deviated flow path as depicted FIG. 9.

FIG. 10 is a schematic cross-sectional elevation view of the downhole tool 900 having a deviated flow path as depicted in FIG. 9. As can be seen in this embodiment, the slots 918 in the inner conduit 912 are curved or arc-shaped to facilitate smooth passage of the fluid from the inner flow path 916 into the annulus 914, with the arcuate slots curving away from the ESP coupling 910. The shape of the slots 918 also makes it more difficult for solid particulates falling in the opposite direction to cross over into the inner conduit 912, thus mitigating fallback of solid particulates into the inner conduit. It is of course possible for the slots 918 to take some other form besides arcuate, such as V-shaped, diagonal, lateral, or even vertical slots, within the scope of the disclosed embodiments.

In some embodiments, a shoulder 932 may be formed on the flow plug 920 as a buttress or backstop against which the terminal end of the inner conduit 912 may press. In such embodiments, the flow plug 920 may be inserted into the opening of the inner conduit 912 until that end of the inner conduit 912 abuts up against the shoulder 932.

Figure 11:
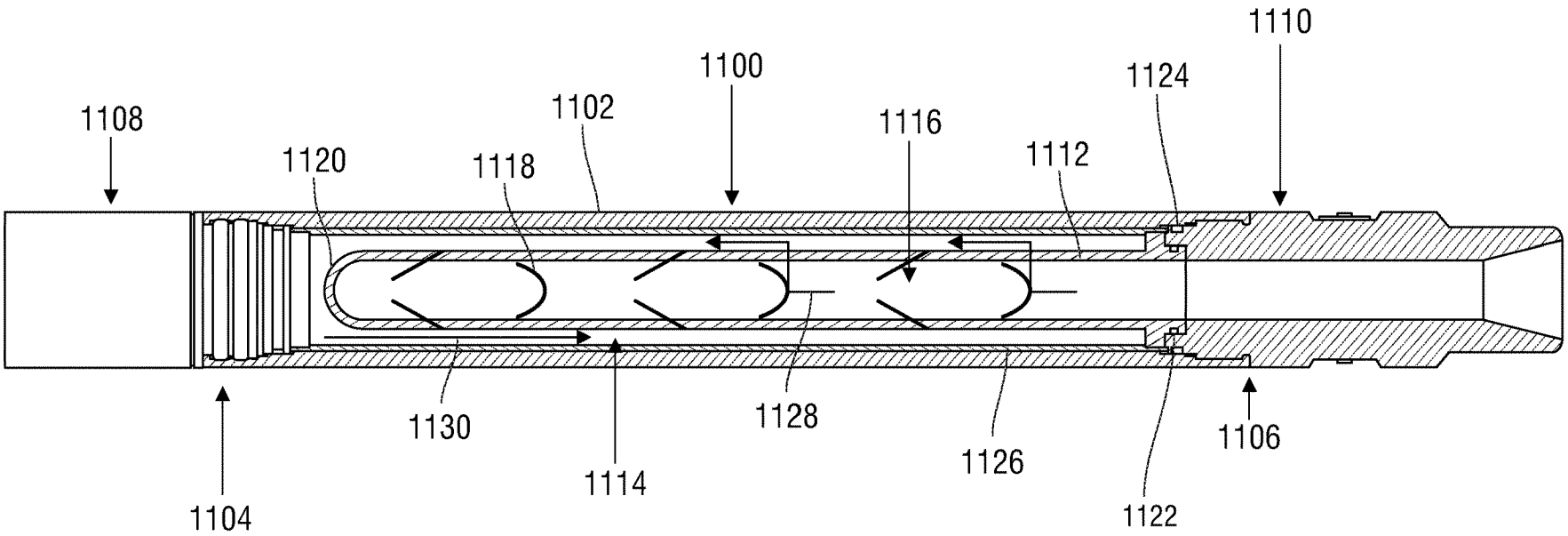
FIG. 11 is a schematic cross-sectional elevation view of an alternative embodiment of the downhole tool having a deviated flow path.

FIG. 11 is a schematic cross-sectional side view showing an alternative downhole tool 1100 that uses an endcap in place of a flow plug. The downhole tool 1100 is similar to the downhole tool 900 except instead of a flow plug, an endcap may be provided on the inner conduit. Like the tool 900, the downhole tool 1100 includes a tool housing 1102 having openings at an upper end 1104 and a lower end 1106. The upper end 1104 is again coupled to a tool coupling 1108 and the lower end 1106 is again coupled to an ESP coupling 1110. An inner conduit 1112 is positioned within the tool housing 1102 to form an annulus 1114 between the inner conduit 1112 and the tool housing 1102. The inner conduit 1112 defines an inner flow path 1116 extending from the ESP coupling 1110 toward the tool coupling 1108. A plurality of slots 1118 in the inner conduit 1112 allow fluid (e.g., from the ESP) to flow from the inner flow path 1116 of the inner conduit 1112 into the annulus 1114 and subsequently to the tool coupling 1108.

The tool coupling 1108, unlike its counterpart in FIG. 9, does not have a flow plug protruding therefrom. Instead, the inner conduit 1112 has an endcap 1120 at the upper end thereof that functions like the flow plug. The endcap 1120 stops fluid from flowing through the inner conduit 1112, forcing the fluid to deviate through the slots 1118 into the annulus 1114. In the embodiment shown, the endcap 1120 is formed as an integral part of the inner conduit 1112. In alternative embodiments, the endcap 1120 may be attached or otherwise connected to the inner conduit 1112 by a suitable connection means (e.g., threads, clamps, hinge, etc.). In such embodiments, one or more seals (not expressly shown) may be provided between the endcap 1120 and the inner conduit 1112 to form a fluid tight seal. These seals may be similar to the inner and outer seals 1122 and 1124 between the ESP coupling 1110 and the tool housing 1102 and inner conduit 1112. In some embodiments, an outer conduit 1126 may again be positioned within the tool housing 1102 such that the annulus 1114 is formed between the inner conduit 1112 and the outer conduit 1126 instead of the tool housing 1102.

In FIG. 11, the exemplary endcap 1120 is depicted as a hemispherical or bowl-shaped endcap. Those having ordinary skill in the art will appreciate that other shapes may be used, such as a conical shape, a tapered shape, or even a rectangular shape, within the scope of the present disclosure.

Operation of the downhole tool 1100 is similar to operation of the tool 900. In general, when the ESP is pumping, fluid flows through the ESP coupling 1110 along the inner flow path 1116 until the fluid encounters the endcap 1120. The endcap 1120 forces the fluid to follow a deviated flow path 1128 that runs through the slots 1118 into the annulus 1114 and continues to the tool coupling 1108. When the ESP shuts down, gravity causes the fluid in the annulus 1114 to fall towards the ESP coupling 1110, reversing through the deviated flow path 1128 back to the ESP coupling 1110. In a solid particulates, however, will largely avoid reversing through the deviated flow path 1128 and will instead continue along a bypass fallback path 1130 in the annulus 1114.

Figure 12:
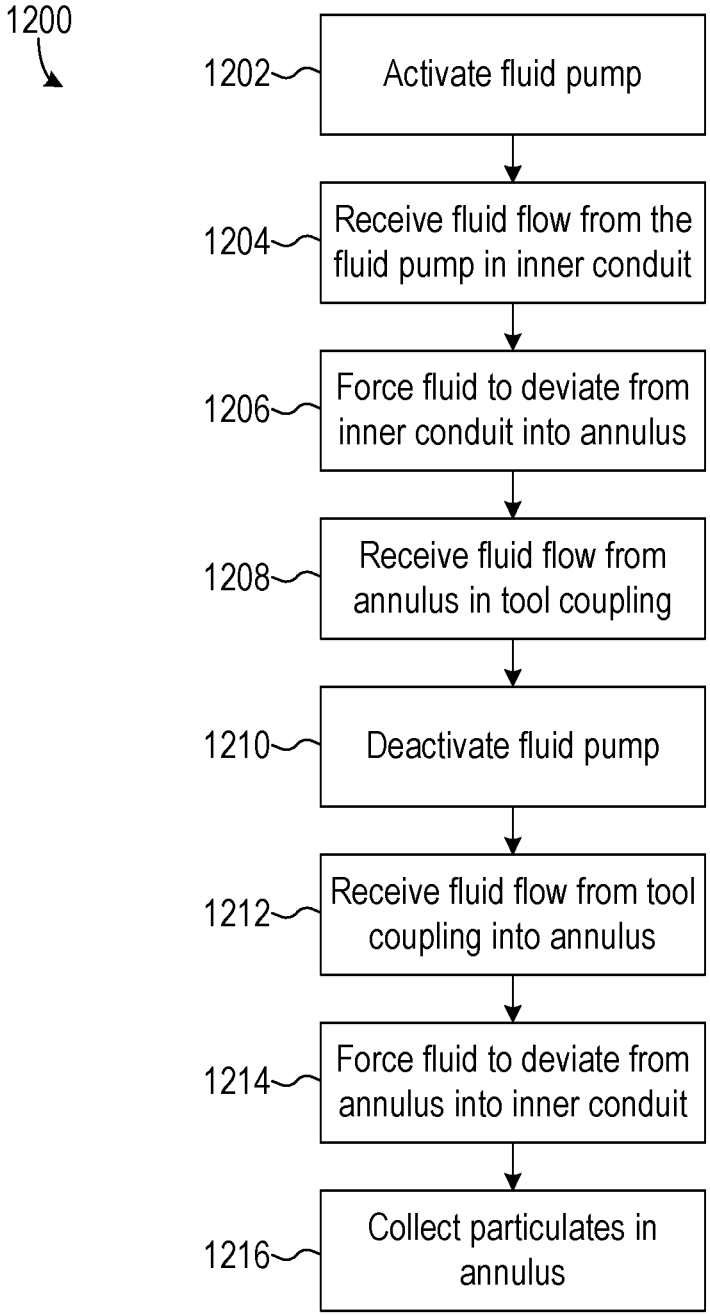
FIG. 12 is a flow diagram illustrating an exemplary method of using a downhole tool having a deviated flow path.

FIG. 12 illustrates a flowchart 1200 for an exemplary method of preventing/mitigating particulate fallback during shutdown of an ESP or other fluid pump using the downhole tool 900 discussed above. The method generally begins when the ESP or other pump is activated and begins pumping at 1202. Thereafter at 1204, fluid begins to flow through the ESP coupling and is received in the inner flow path of the inner conduit. The fluid continues to flow until encountering a flow stop, such as the flow plug or endcap mentioned above, at the upper end of the inner conduit, at 1206, and is forced to follow the deviated flow path through the slots in the inner conduit into the annulus. The fluid flows along the annulus and is received in the tool coupling, at 1208, where it continues to flow up the string toward the surface. When the ESP or other fluid pump is shut down, at 1210, gravity causes the fluid flow to reverse direction and begin flowing downhole. The fluid is received back into the annulus, at 1212, and continues flowing towards the ESP coupling. The fluid is forced by virtue of the inner and outer seals between the ESP coupling, tool housing, and inner conduit to flow back through the deviated flow path into the inner conduit, at 1214. From there, the fluid continues flowing into the ESP coupling and further downhole. However, due to their mass, any solid particulates in the fluid will resist a change in direction more than the fluid. As a result, the solid particulates will largely avoid reversing through the deviated flow path into the inner conduit and will instead continue along a bypass fallback in the annulus, at 1216, where the particulates may accumulate for later removal. Such an arrangement helps the downhole tool prevent/mitigate fallback of solid particulates into the inner conduit and down to the ESP without the need for poppet, check, diverter, or other mechanical valves.

Accordingly, as set forth above, the embodiments disclosed herein may be implemented in a number of ways. For example, in general, in one aspect, the disclosed embodiments relate to a downhole tool for sand fallback prevention. The downhole tool comprises, among other things, a generally tubular housing defining an upper opening, a lower opening, and a passage therebetween. The downhole tool also comprises a generally tubular inner conduit coaxially positioned within the housing so as to form an annulus in the housing, the inner conduit having an upper end and a lower end and defining an inner flow path therebetween, the inner conduit having a plurality of slots therein that allow fluid to flow between the inner flow path and the annulus. A flow stop terminates the inner conduit at the upper end thereof, the flow stop configured to plug or cap the upper end of the inner conduit.

In general, in another aspect, the disclosed embodiments relate to a method of preventing particulate fallback in a downhole tool. The method comprises, among other things, receiving fluid flow from a fluid pump in fluid communication with the downhole tool, the fluid flow received within a generally tubular inner conduit having an upper end and a lower end and defining an inner flow path therebetween in which the fluid flow is received, the inner conduit coaxially positioned within a generally tubular housing that defines an upper opening, a lower opening and a passage therebetween, the housing and the inner conduit forming an annulus therebetween. The method further comprises forcing the fluid flow to deviate from the inner flow path in the inner conduit through a plurality of slots in the inner conduit into the annulus between the inner conduit and the housing. A flow stop terminates the inner conduit at the upper end thereof, the flow stop plugging or capping the upper end of the inner conduit to force the fluid flow to deviate through the plurality of slots.

In general, in yet another aspect, the disclosed embodiments relate to a downhole assembly for particulate fallback prevention. The downhole assembly comprises, among other things, a downhole tool, a tool coupling connected to an uphole end of the downhole tool, and a pump coupling connected to a downhole end of the downhole tool. The downhole tool includes a generally tubular housing and a generally tubular inner conduit coaxially positioned within the housing to form an annulus in the housing, the inner conduit having an upper end and a lower end and defining an inner flow path therebetween, the inner conduit having a plurality of slots therein that allow fluid to flow between the inner flow path and the annulus. A flow plug terminates the inner conduit at the upper end thereof to plug or cap the upper end and force fluid to flow through the plurality of slots.

In accordance with any of the foregoing embodiments, the downhole tool further comprises a generally tubular outer conduit coaxially positioned within the housing such that the annulus in the housing is formed between the outer conduit and the inner conduit.

In accordance with any of the foregoing embodiments, one or more of the plurality of slots are lateral slots, diagonal slots, V-shaped slots, or arcuate slots.

In accordance with any of the foregoing embodiments, the flow stop is one of a flow plug coupled to the inner conduit or an endcap at the upper end of the inner conduit. In accordance with any of the foregoing embodiments, the flow plug has a shoulder portion and the inner conduit abuts the shoulder portion of the flow plug. In accordance with any of the foregoing embodiments, the flow plug is positioned within the upper end of the inner conduit.

In accordance with any of the foregoing embodiments, at least one seal is provided around the inner conduit adjacent the lower end of the inner conduit.

The methods and systems of the present disclosure, as described above and shown in the drawings, provide for reduction or prevention of fallback sand reaching an ESP with superior properties including accommodation for desirable back flow, extended useable life, and improved reliability relative to traditional systems and methods.

While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A method of preventing particulate fallback in a downhole tool, comprising:

receiving fluid flow from an electrical submersible pump (ESP) assembly fluidically coupled with the downhole tool, the fluid flow received within a generally tubular ESP coupling without a check valve device and with an inner flow path coupled to a generally tubular single-piece inner conduit having an upper end and a lower end extending the inner flow path therebetween in which the fluid flow is received, the inner conduit coaxially positioned within a generally tubular housing that defines an upper opening, a lower opening and a passage therebetween, the housing and the inner conduit forming an annulus therebetween, and wherein a check valve device is not located below the ESP assembly; and forcing the fluid flow to deviate from the inner flow path in the inner conduit through a plurality of closed-ended slots in the inner conduit into the annulus between the inner conduit and the housing;

wherein a flow stop terminates the inner conduit at the upper end thereof, the flow stop plugging or capping the upper end of the inner conduit to force the fluid flow to deviate through the plurality of slots.

2. The method as recited in claim 1, wherein forcing the fluid flow to deviate comprises forcing the fluid flow to deviate into a generally tubular outer conduit coaxially positioned within the housing such that the annulus in the housing is formed between the outer conduit and the inner conduit.

3. The method as recited in claim 1, wherein one or more slots in the plurality of slots are lateral slots, diagonal slots, V-shaped slots, or arcuate slots.

4. The method as recited in claim 3, wherein the flow stop is one of a flow plug coupled to the inner conduit or an endcap at the upper end of the inner conduit.

5. The method as recited in claim 4, wherein the flow plug is positioned within the upper end of the inner conduit.

6. The method as recited in claim 5, wherein the flow plug has a shoulder portion and the inner conduit abuts against the shoulder portion of the flow plug.

7. The method as recited in claim 3, wherein the slots comprise at least one set of two slots radially spaced at 180 degrees apart about the longitudinal axis.

8. The method as recited in claim 7, wherein at least two sets of slots are axially spaced along the longitudinal axis.

9. The method as recited in claim 1, wherein at least one seal is disposed around the inner conduit adjacent the lower end of the inner conduit.

10. The method as recited in claim 1, wherein the flow stop and the single piece inner conduit have a unitary construction.

11. A downhole assembly for particulate fallback prevention, comprising:

an electrical submersible pump (ESP) assembly; and a downhole tool comprising:

a generally tubular housing defining an upper opening, a lower opening, and a passage therebetween;

a generally tubular single-piece inner conduit coaxially positioned within the housing to form an annulus in the housing, the inner conduit having an upper end and a lower end and defining an inner flow path therebetween, the inner conduit having a plurality of closed-ended slots therein that allow fluid to flow between the inner flow path and the annulus;

a generally tubular ESP coupling without a check valve device, wherein the housing is mechanically coupled to the ESP coupling, wherein the inner conduit is sealingly coupled to the ESP coupling, wherein the inner flow path of the inner conduit extends through the ESP coupling, and wherein the fluid flow through the inner flow path through the ESP coupling and the inner conduit is unobstructed by a check valve device;

wherein the ESP coupling is i) coupled to or ii) located uphole to the ESP assembly, and wherein a check valve device is not located between the ESP coupling and the ESP assembly; and wherein a flow stop terminates the inner conduit at the upper end thereof, the flow stop configured to plug or cap the upper end of the inner conduit to force fluid to flow through the plurality of slots;

wherein a check valve device is not located below the ESP assembly.

12. The downhole assembly as recited in claim 11, further comprising a generally tubular outer conduit coaxially positioned within the housing such that the annulus in the housing is formed between the outer conduit and the inner conduit.

13. The downhole assembly as recited in claim 11, wherein one or more slots in the plurality of slots are lateral slots, diagonal slots, V-shaped slots, or arcuate slots.

14. The downhole assembly as recited in claim 13, wherein the slots comprise at least one set of two slots radially spaced at 180 degrees apart about the longitudinal axis.

15. The downhole assembly as recited in claim 14, wherein at least two sets of slots are axially spaced along the longitudinal axis.

16. The downhole assembly as recited in claim 11, wherein the flow stop is one of a flow plug protruding from the tool coupling and coupled to the inner conduit or an endcap at the upper end of the inner conduit.

17. The downhole assembly as recited in claim 16, wherein the flow plug is positioned within the upper end of the inner conduit.

18. The downhole assembly as recited in claim 17, wherein the flow plug has a shoulder portion and the inner conduit abuts against the shoulder portion of the flow plug.

19. The downhole assembly as recited in claim 11, further comprising at least one seal around the inner conduit adjacent the lower end of the inner conduit.

20. The downhole assembly as recited in claim 11, wherein the flow stop and the single piece inner conduit have a unitary construction.

* * * * *